US006561623B1

(12) United States Patent
Aono et al.

(10) Patent No.: US 6,561,623 B1
(45) **Date of Patent: *May 13, 2003**

(54) METHOD FOR PRODUCING INK JET RECORDING HEAD AND INK JET RECORDING HEAD PRODUCED BY SAME

(75) Inventors: Kenji Aono, Kawasaki (JP); Akihiko Shimomura, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/704,107

(22) Filed: Aug. 28, 1996

(30) Foreign Application Priority Data

Aug. 31, 1995 (JP) ..... 7-223473

(51) Int. Cl.[7] ..... B41J 2/135
(52) U.S. Cl. ..... 347/45
(58) Field of Search ..... 347/45, 47

(56) References Cited

U.S. PATENT DOCUMENTS

| | | | | |
|---|---|---|---|---|
| 4,723,129 A | * | 2/1988 | Endo et a. | 347/45 |
| 5,436,650 A | | 7/1995 | Kobayashi et al. | 347/63 |
| 5,659,343 A | * | 8/1997 | Koizumi et al. | 347/47 |
| 5,754,202 A | * | 5/1998 | Sekiya et al. | 347/63 |

FOREIGN PATENT DOCUMENTS

| | | | | |
|---|---|---|---|---|
| EP | 0481788 | | 4/1992 | |
| EP | 612621 | * | 3/1994 | 347/45 |
| GB | 2283208 | | 5/1995 | |
| JP | 5-229130 | | 9/1993 | |
| JP | 6-8448 | | 1/1994 | |

OTHER PUBLICATIONS

Webster's Ninth New Collegiate Dictionary, p. 876, 1990.*
Hawley's Condensed Chemical Dictionary, Richard S. Lewis, Jr., 13th Edition, 1997).

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A method is provided for producing an ink jet recording head comprising a discharge opening for discharging an ink, a discharge opening forming member for forming the discharge opening, a liquid flow path communicating with the discharge opening, and a liquid discharge energy generating portion arranged within the liquid flow path for generating an energy to be utilized for discharging the ink from the discharge opening. The discharge opening forming member is dipped into a liquid which has ink-repellence and permeates into the discharge opening forming member. As a result, an ink-repellent treatment is effected on a peripheral portion of the discharge opening.

8 Claims, 3 Drawing Sheets

METHOD FOR PRODUCING INK JET RECORDING HEAD AND INK JET RECORDING HEAD PRODUCED BY SAME

BACKGROUND OF THE INVENTION

1. Field of the Invention

The present invention relates to a method for producing an ink jet recording head, in which a recording liquid generally called ink is discharged to fly in the form of a fine droplet from a fine opening, thereby depositing the fine droplet onto a recording surface to effect recording. More particularly, the invention relates to a method for producing an ink jet recording head in which the discharge opening surface of the ink jet recording head is surface treated.

2. Related Background Art

As shown in FIG. 1, generally, an ink jet recording head which is applied to the ink jet recording system is provided with fine ink discharge openings 4, liquid flow paths 6 and liquid discharge energy generating portions (not shown) arranged in the liquid flow paths. It is known that a peripheral portion of a discharge opening of the recording head is generally preferred to be ink-repellent from the view point of discharge stability. Further, the peripheral portion is exposed to an environment in which it is subject to wear or damage due to dust or foreign matters contained in the air or due to the contact with the recording media such as paper. For this reason, the peripheral portion is subjected to a treatment by which a material having ink repellence and some degree of abration resistance is applied.

As the method for imparting ink repellence to the discharge opening peripheral portion, besides the above mentioned method for applying an ink-repellent material onto the discharge opening peripheral portion, there can be included a method for forming a discharge opening of an ink-repellent material itself, a method of partially modifying the surface of the discharge opening forming member by implanting fluorine ions into a discharge opening peripheral portion or applying a fluorine plasma treatment thereto, and the like.

However, since, generally speaking, a coating material that is excellent in ink repellence does not always have a sufficient abration resistance, the above-described method for applying an ink-repellent material onto a discharge opening peripheral portion suffers from a problem that the peripheral portion may be damaged sometimes due to the cleaning step (wiping) for the discharge opening peripheral portion or the like, so that a discharge direction of ink may be deflected to deteriorate the printing quality level.

Also, as for the method for forming a discharge opening of an ink-repellent material itself, there is a fear that, since the ink-repellence is exhibited also in the liquid flow path, a good meniscus condition can not be maintained in the vicinity of the discharge opening, thus deteriorating the printing quality.

Furthermore, in the method of partially modifying the surface of the discharge opening forming member by implanting fluorine ions into a discharge opening peripheral portion or by applying a fluorine plasma treatment thereto, there is a problem that not only a large scale equipment is needed but also it is difficult to control to what degree the discharge opening peripheral portion of a discharge opening forming member is ink-repellent treated.

Thus, heretofore, there have been demands for a method for producing an ink jet recording head by which an ink jet recording head that is excellent in both ink repellence and abration resistance and has a high printing quality can be produced in low cost and at high yield.

SUMMARY OF THE INVENTION

In order to overcome the above-noted defects, an object of the present invention is to provide a method for producing an ink jet recording head which has good discharge stability and is excellent in productivity, and to provide an ink jet recording head produced by the method.

This and other objects are accomplished in accordance with the present invention by providing a method for producing an ink jet recording head comprising a discharge opening for discharging an ink, a discharge opening forming member for forming the discharge opening, a liquid flow path communicating with the discharge opening, and a liquid discharge energy generating portion arranged within the liquid flow path for generating an energy to be utilized for discharging the ink from the discharge opening, the method comprising dipping the discharge opening forming member into a liquid which has ink-repellence and permeates into the discharge opening forming member, whereby an ink-repellent treatment is effected on a peripheral portion of the discharge opening.

In the method for producing an ink jet recording head according to the present invention, since the ink-repellent treatment may be attained only by putting the discharge opening surface into a dipping tank, an equipment to be used for the ink-repellent treatment may be simplified, and it is possible to accurately carry out the desired treatment without complicated control of the treatment equipment. Accordingly, the productive yield is improved. Furthermore, in the ink jet recording head according to the present invention, since the ink-repellent substance permeates into the structural material (i.e., the discharge opening forming member) of the discharge opening surface, the hardness of the ink-repellent treated region of the discharge opening peripheral portion is substantially equal to that of the discharge opening forming member, whereby it is possible to keep a satisfactory abration resistance. Accordingly, a damage is hardly raised in the discharge opening peripheral portion and the ink discharge stability can be kept at a good level.

DETAILED DESCRIPTION OF THE PREFERRED EMBODIMENTS

The present invention will now be described in more detail with reference to the accompanying drawings.

FIGS. 2A to 2G are views of steps of one embodiment of the method for producing an ink jet recording head in accordance with the invention.

Figure 1:
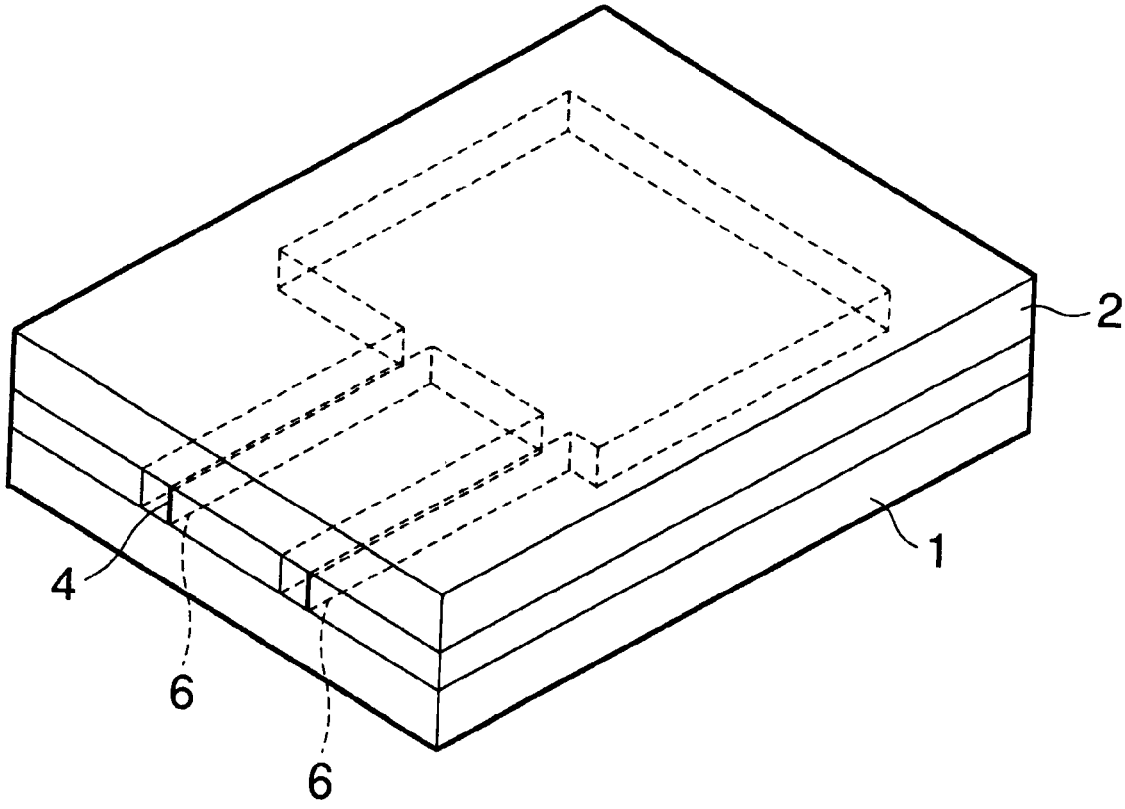
FIG. 1 is a schematic perspective view illustrative of a conventional ink jet recording head.
Figure 2A:
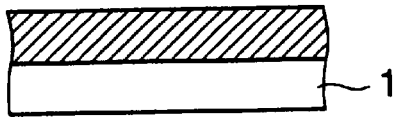
FIGS. 2A to 2G are illustrations of steps of an embodiment of a method for producing an ink jet recording head in accordance with the present invention.
Figure 2B:
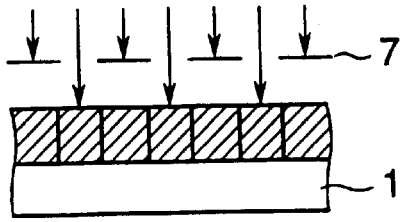
Figure 2C:
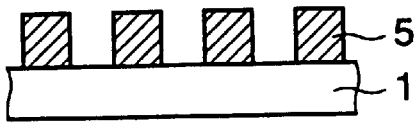
Figure 2D:
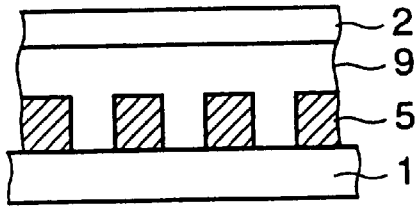
Figure 2E:
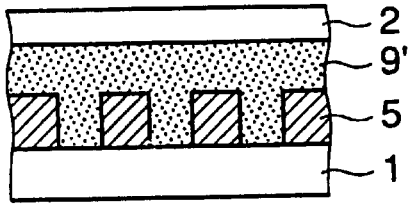
Figure 2F:
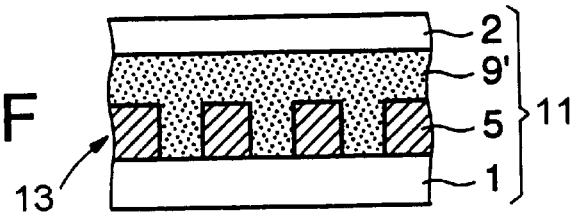

First of all, a photosensitive resin layer is formed on a substrate 1 to be treated, having a liquid discharge energy generating portion (see FIG. 2A). This is light exposured through a mask 7 (see FIG. 2B). A developing treatment is carried out to pattern the photosensitive resin layer to form a solid layer 5 in a portion that will become a liquid flow path later (see FIG. 2C). In this case, a metal substrate such as an Si substrate or an Al substrate may be used as the substrate 1 to be treated. Also, in case of a full line type ink jet recording head in which a plurality of ink discharge openings are provided over the full width of a recording region of the recording medium, the metal substrate is preferably used because it may readily be machined. An electromechanical transducer, an electrothermal transducer or the like may be used as the liquid discharge energy generating portion. In particular, the electrothermal transducer is very suitable in the case where discharge openings are arranged at a high density. Also, any type photosensitive resin may be used as the material for the solid layer if it may be dissolved and removed later. It is possible to use a dry film type one or a liquid type one. Incidentally, in case of the liquid type photosensitive resin, it is possible to form its layer on a substrate by spin coating or the like. Subsequently, a ceiling plate 2 having an ink supply port is aligned with the substrate 1 (see FIG. 2D). A resin 9 of an active energy ray curing type or thermosetting type which becomes a liquid flow path forming member 9' is injected between the ceiling plate 2 and the substrate 1 (see FIG. 2D). The resin which becomes (or defines) the liquid flow path forming member is cured or hardened by active energy ray projection or heating (see FIG. 2E). Thereafter, the discharge opening peripheral portion of the discharge opening forming member composed of the ceiling plate 2, the liquid flow forming member 9', and substrate 1 is dipped in a liquid that has the ink-repellence and permeates into the discharge opening forming member to thereby impart ink-repellence to the discharge opening peripheral portion (see FIG. 2F). The liquid having such properties includes, for example, CRYSTALON solution (Trade Name, manuf. by Nano Film Corporation). In this case, in order to allow the liquid to permeate well into the discharge opening peripheral portion, it is preferable that at least the discharge opening peripheral portion of the discharge opening forming member be made of a resin or an inorganic insulating material. Accordingly, in the case where the substrate also serves as a part of the discharge opening forming member as described above, it is preferable to form an inorganic insulating film 14 on the discharge opening peripheral portion of the substrate. In particular, in the case where the substrate is made of a metal, the metal substrate may be anodized to form an excellent quality film through which the liquid may readily permeate.

Figure 2G:
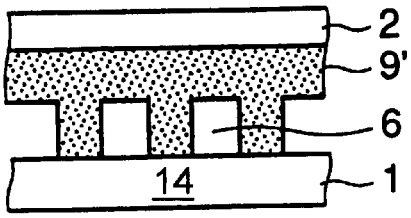

Finally, the solid layer is removed by using an organic solvent or alkaline solution or the like to thereby form the liquid flow path 6 (see FIG. 2G).

Figure 3:
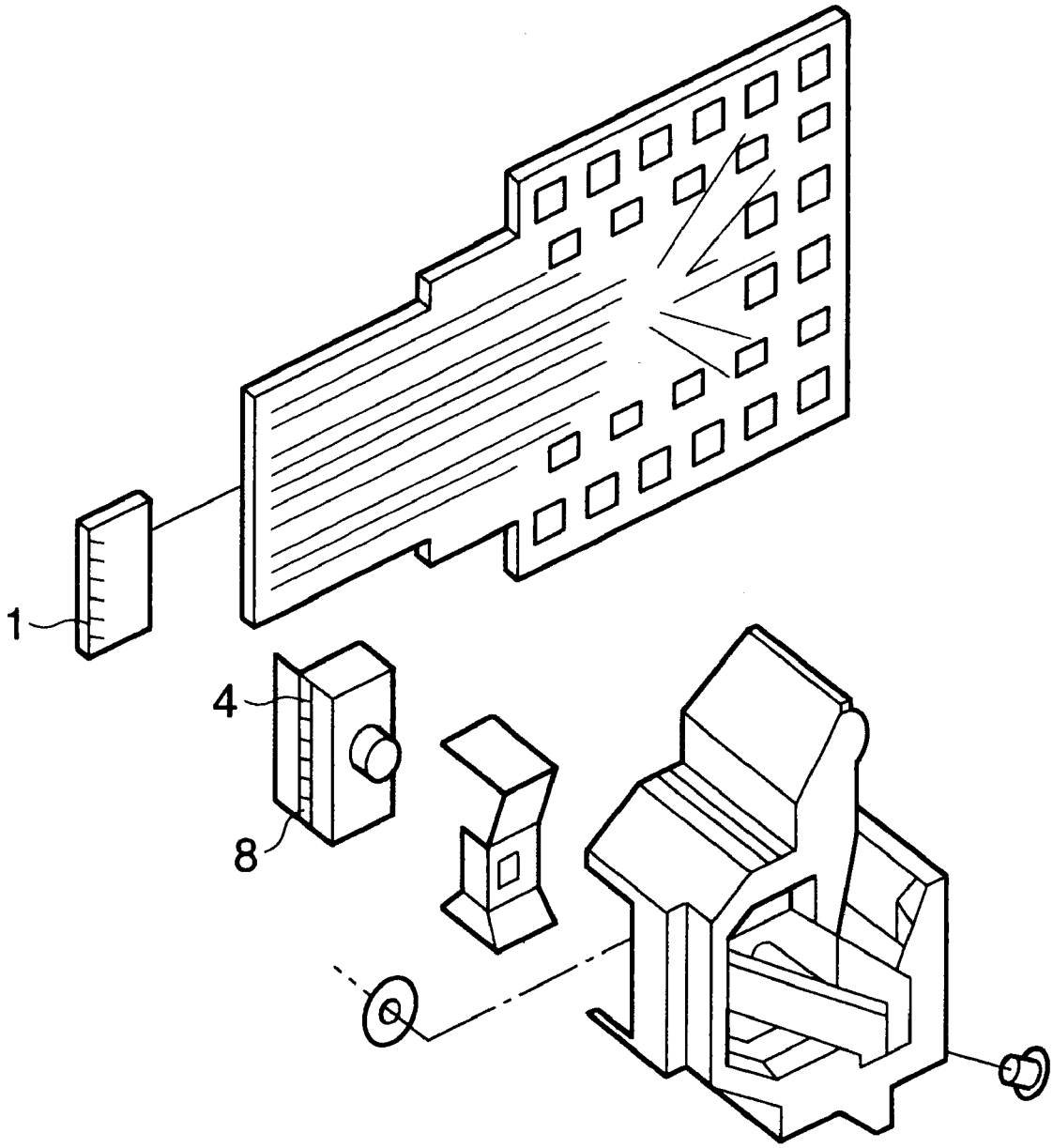
FIG. 3 is an exploded perspective view showing another embodiment of the ink jet recording head according to the invention.

In the foregoing embodiment, the discharge opening forming member is composed of a plurality of members. However, as shown in FIG. 3, a member 8 formed by molding a resin is solely used as the discharge opening forming member so that excellent ink-repellence may be imparted to the discharge opening forming member in the same manner as in the foregoing embodiment. Incidentally, in this embodiment, the discharge openings 4 may be formed by laser beam maachining after the dipping treatment so that the discharge openings may easily be formed with high precision without turning the ink repellent substance into the liquid flow paths.

EXAMPLE 1

A positive type photoresist PMER-AR900 (manuf. by Tokyo Ohka Kogyo Co.) was spin-coated as the photosensitive resin on an Al substrate 1 on which an electrothermal transducer is formed as a liquid discharge energy generating portion. After it was pre-baked, an exposure was carried out at a dose of 3 j/cm$^2$ by a mask aligner PLA-501 (manuf. by Canon K.K.) through a liquid flow path mask pattern 7. Thereafter, a development treatment was carried out and a post-bake was effected to form a solid-layer 5 which defines the flow path.

Subsequently, the solid layer 5 was coated with the liquid flow path forming member 9. A ceiling plate 2 made of glass was then laminated on the liquid flow path forming member 9 and the liquid flow path forming member 9 was cured. After curing, the laminated member of the substrate 1, the liquid flow path forming member 9 and the ceiling plate 2 was cut for forming a discharge opening surface of the recording head.

Next, in order to form an anodic oxide layer on the cut surface of the substrate, a mixture solution of ammonium tartrate and ethylene glycol was prepared and filled in a bath. The cut surface of the recording head was dipped into the solution in the bath. Then, an electric power was applied thereto under the conditions of 250 V and 2.5 A by using a constant voltage power source to form the anodic oxide layer on the end face of the aluminum substrate.

Next, the discharge opening surface was dipped in CRYSTALON solution (manuf. by Nano Film Corporation) for five minutes at 90° C. to effect the water-repellent treatment. Finally, the resist was dissolved and removed by dipping in acetone to form the discharge openings to complete the ink jet recording head.

EXAMPLE 2

A discharge opening surface of a ceiling plate 8 integrally formed with the discharge opening forming member and the liquid flow paths by molding and made of polyether sulfone resin was dipped in CRYSTALON solution (manuf. by Nano Film Corporation) at 90° C. for five minutes to thereby effect the water-repellent treatment. Next, the discharge openings were formed by laser beam machining. Finally, the ceiling plate integrally having the discharge opening forming member and the liquid flow paths was bonded to the same substrate as used in Example 1 to complete the ink jet recording head.

COMPARATIVE EXAMPLE

Florene C1-25 (trade mane, manuf. by Nihon Synthetic Rubber Co.) was applied as a water-repellent on the discharge opening surface of a ceiling plate integrally formed with liquid flow paths by molding and made of polyether sulfone resin to form a water-repellent treated layer. Next, the discharge openings were formed by laser beam machining. Finally, the above-described ceiling plate was bonded to the same substrate as used in Example 1 to thereby complete the ink jet recording head.

100 pieces of ink jet recording heads were produced in accordance with each of Examples 1 and 2 and Comparative Example. Each of the ink jet printheads was installed on an Ink Jet Printer BJC-880 (manuf. by Canon K.K.) and the printing was carried out. The quality level evaluation was conducted for the initial print and the thousandth print.

The results are shown in Table 1

TABLE 1

Table 1 Results of Evaluation of Printing Quality Level

| | Initial print | 1,000 th print |
|---|---|---|
| Example 1 | 100 | 100 |
| Example 2 | 100 | 100 |
| Comparative Example | 100 | 93 |

The evaluation results were represented in terms of the number of the heads which were subjected to neither deflection nor non-ejection, out of 100 heads.

As is clear from Table 1, the heads according to Comparative Example was good in the initial print in printing quality level. However, after 1,000 printing, the degraded printing quality level was observed. This is considered to be due to the peeling off of the water-repellent layer at the discharge opening peripheral portion. In contrast, the printing quality level of the heads according to Examples 1 and 2 was good without any deflection or non-ejection in both the initial print and the 1,000th print.

Incidentally, in the foregoing examples, the explanation was given as to the serial type recording head. However, it is apparent that the present invention may be applied to a full line type recording head in which the discharge openings are formed over all the width of a recording region of the recording medium. Also, in the foregoing examples, the electrothermal transducer is used for the energy generating element. However, it is apparent that the present invention may be applied to an ink jet head having any other energy generating element than those described above.

What is claimed is:

1. A method for producing an ink jet recording head that has an inorganic substrate in which is provided a discharge opening for discharging an ink, a discharge opening forming member for forming the discharge opening, the discharge opening forming member being made from a material such that a liquid can permeate thereinto, a liquid flow path communicating with the discharge opening, and a liquid discharge energy generating portion arranged within the liquid flow path for generating energy to be utilized for discharging the ink from the discharge opening, at least a portion of the discharge opening forming member comprising a resin, the method comprising the steps of:

providing the ink jet recording head;

dipping the discharge opening forming member in a liquid having ink-repellence;

as a result of said dipping, permeating the liquid having ink repellence into the discharge opening forming member such that the ink-repellent component of the liquid permeates into the resin of the discharge opening forming member, whereby an ink-repellent treatment is effected on a peripheral portion of the discharge opening provided in the inorganic substrate, thereby providing the discharge opening forming member with ink-repellent properties; and forming an inorganic insulating film on the discharge opening peripheral portion of the inorganic substrate before effecting said ink-repellent treatment, wherein the inorganic substrate comprises a metal, and wherein the inorganic insulating film is formed by anodizing the inorganic substrate.

2. The method for producing an ink jet recording head according to claim 1, wherein the discharge opening forming member is a resin molded member.

3. The method for producing an ink jet recording head according to claim 2, wherein the discharge opening is formed by laser beam machining the discharge opening forming member.

4. The method for producing an ink jet recording head according to claim 1, wherein the discharge opening forming member comprises the inorganic substrate, and the inorganic substrate is provided with the liquid discharge energy generating portion and a ceiling plate made of the resin.

5. The method for producing an ink jet recording head according to claim 4, further comprising the steps of:

providing on the inorganic substrate a soluble solid layer;

coating the substrate having the solid layer provided thereon with a liquid flow path forming member for constituting the ceiling plate; and dissolving and removing the solid layer after curing the liquid flow path forming member, thereby forming the discharge opening and the liquid flow path.

6. An ink jet recording head produced by the method for producing an ink jet recording head according to claim 1.

7. The ink jet recording head according to claim 6, wherein said liquid discharge energy generating portion is an electrothermal transducer.

8. The ink jet recording head according to claim 6, which is of a full line type in which a plurality of said ink discharge openings are provided over a full width of a recording region of a recording medium.

* * * * *